US006109173A

United States Patent [19]

Nakayama

[11] Patent Number: 6,109,173

[45] Date of Patent: Aug. 29, 2000

[54] STENCIL PRINTING MACHINE

[75] Inventor: Koji Nakayama, Ibaraki-ken, Japan

[73] Assignee: Riso Kagaku Corporation, Tokyo, Japan

[21] Appl. No.: 09/406,142

[22] Filed: Sep. 27, 1999

[30] Foreign Application Priority Data

Sep. 29, 1998 [JP] Japan ..... 10-275347

[51] Int. Cl.[7] ..... B41F 21/04

[52] U.S. Cl. ..... 101/118; 101/410

[58] Field of Search ..... 101/116, 117, 101/118, 119, 120, 409, 410, 411; 271/82, 85

[56] References Cited

U.S. PATENT DOCUMENTS 5,553,544 9/1996 Ramsay ..... 101/409
5,960,716 10/1999 Schaede ..... 101/116

FOREIGN PATENT DOCUMENTS 0 756 939 2/1997 European Pat. Off. .
0 887 798 12/1998 European Pat. Off. .

*Primary Examiner*—Stephen R. Funk
*Attorney, Agent, or Firm*—Kanesaka & Takeuchi

[57] ABSTRACT

A stencil printing machine includes a printing drum having a flexible ink-permeable circumferential wall adapted to receive a perforated stencil sheet around an outer circumferential surface thereof, the printing drum being driven to rotate around a central axis thereof; a pressing device situated inside the printing drum for supplying ink to an inner surface of the circumferential wall, the pressing device being movable between a pressing position for pressing the circumferential wall to be deformed radially outwardly and a standing position for releasing the circumferential wall from deformation; an opposing drum disposed adjacent to the printing drum and driven to rotate in a direction opposite to that of the printing drum, the opposing drum having a recess formed in an outer circumferential surface thereof; a clamp disposed on an outer circumferential surface of the opposing drum and operating in synchronization with rotation of the opposing drum to hold a leading edge of a printing sheet supplied between the printing drum and the opposing drum; a clamp cover disposed on the outer circumferential surface of the opposing drum adjacent to the clamp relative to the direction of rotation of the opposing drum and covering the recess formed in the opposing drum for allowing operation of the clamp, the clamp cover selectively opening and closing the recess in synchronization with operation of the clamp; and a driving mechanism for driving the clamp cover to move alternately in a circumferential direction of the opposing drum and in a radial direction of the opposing drum.

5 Claims, 20 Drawing Sheets

STENCIL PRINTING MACHINE

BACKGROUND OF THE INVENTION

1. Field of the Invention

The present invention relates to a stencil printing machine, especially to a machine having a mechanism for preventing ink-leakage from a printing drum.

2. Description of the Related Art

In Japanese Patent Application 63-28553 (Japanese Laid Open Publication No. 1-204781), Japanese Patent Application 1-47029 (Japanese Laid Open Publication No. 2-225078), and Japanese Patent Application 2-223550 (Japanese Laid Open Publication No. 4-105984), the present applicant proposed a stencil printing machine. This stencil printing machine has a printing drum, an ink-applying roller situated inside the printing drum, and a back-pressing roller (an opposing drum) disposed under the printing drum. The printing drum has a base body comprising two annular members coaxially arranged at a predetermined distance therebetween and a connecting member connecting the two annular members. A flexible and ink-permeable circumferential wall is wrapped around the base body. Namely, one end of the circumferential wall is fixed to the base body, and the other end is attached to the base body by an elastic member. The ink-applying roller is situated inside the printing drum for providing ink to an inner surface of the circumferential wall. The ink-applying roller is movable between a pressing position for pressing the circumferential wall to be deformed radially outwardly and a standing position for releasing the circumferential wall from deformation. The back-pressing roller is situated under the printing drum and arranged parallel with the printing drum. The back-pressing roller is driven to rotate in a direction opposite to that of the printing drum. In the constitution explained above, a perforated stencil sheet is wrapped around an outer circumferential surface of the circumferential wall of the printing drum, and then stencil printing is started. A printing sheet is supplied between the printing drum and the back-pressing roller. The ink-applying roller deforms the printing drum outwardly. The printing sheet is conveyed while being sandwiched between the printing drum and the back-pressing roller, thereby being printed.

Further, in Japanese Patent Application No. 3-162218 (Japanese Laid Open Publication No. 4-361043), the present applicant proposed a stencil printing method using the stencil printing machine of the constitution stated above. In this method, the back-pressing roller has a clamp for holding a leading end of the printing sheet. The printing sheet held by the clamp on the back-pressing roller is peeled off from the printing drum just after printing, so that a distinct and uniform printed image without faintness can be obtained and set-off does not occur.

Further, in Japanese Patent Application No. 5-306033 (Japanese Laid Open Publication No. 7-137419), the present applicant proposed a stencil printing machine in which a longitudinal position, i.e. head and tail position, of a printed image on a printing sheet can be adjusted by adjusting a rotational position of a printing drum relative to a back-pressing roller.

Further, in the case where a clamp is disposed on the back-pressing roller for holding a leading end of the printing sheet, the back-pressing roller must have a recess formed therein for avoiding interference with a rear edge of the clamp, so that the clamp can open and close. However, when the clamp of the back-pressing roller meets the printing drum, ink may leak from between the printing drum and a stencil sheet, and transfer into the recess formed adjacent to the rear edge of the clamp. And, in Japanese Patent Application No. 7-214075 (Japanese Laid Open Publication No. 9-39359), the present applicant proposed that a strip of an elastic sheet be attached to an outer circumferential surface of the back-pressing roller parallel to a generating line for covering the clamp to prevent such a trouble.

FIG. 18 is a schematic view illustrating a publicly known basic constitution of a stencil printing machine. This machine comprises the printing drum, the ink-applying roller, the back-pressing roller, each of them are explained above, and the clamp disposed on the back-pressing roller for holding the leading end of the printing sheet. In this drawing, the reference numeral "10" indicates the printing drum, and "14" indicates the back-pressing roller. The printing drum 10 has a frame. The frame is composed of a pair of annular members 16, 16 and a connecting member 18 connecting the pair of annular members. The annular members are arranged at both end portions of an axis of the printing drum. The connecting member is parallel to the axis of the printing drum. A flexible porous sheet 20 is in a developed form of rectangular, and the sheet is wound around the frame. Namely, a front edge 20*a* and a rear edge 20*b* are attached to the connecting member in such a manner that both side edges of the sheet contact outer circumferential surfaces of the annular members. Especially as concerns attachment of the rear edge 20*b* to the connecting member 18, Japanese Patent Application 1-47029 (Japanese Laid Open Publication No. 2-225078), Japanese Patent Application 5-306028 (Japanese Laid Open Publication No. 7-137415), and Japanese Patent Application 5-306029 (Japanese Laid Open Publication No. 7-137416) should be referred to.

A circumferential wall of the printing drum 10 is composed of the flexible porous sheet 20, and a stencil sheet 19 is wrapped around an outer surface of the wall with its leading end held on the connecting member 18 by a clamp 21.

The front edge 20*a* and the rear edge 20*b* of the flexible porous sheet 20 are of non-porous structure. A middle portion 20*c* between the edges is of porous structure allowing ink to pass through. The non-porous edges 20*a* and 20*b* of the flexible porous sheet 20 and the connecting member 18 constitute a stencil-sheet leading-end attachment portion 10*a*. The portion is a non-porous strip-shaped area elongated along a generating line of the printing drum 10 between both side edges of the drum.

On the back-pressing roller 14, a traverse groove 22 is formed parallel to its center axis along a generating line. The printing drum 10 and the back-pressing roller 14 have the same diameter. The drum and the roller are driven to rotate in directions opposite to each other in such a manner that the stencil-sheet leading-end attachment portion 10*a* and the traverse groove 22 of the back-pressing roller periodically meet in synchronization with each other. As shown in FIG. 18, the rotating direction of the printing drum 10 is anti-clockwise, and the rotating direction of the back-pressing roller 14 is clockwise.

An ink supplying roller 12 is situated inside the printing drum 10. The ink supplying roller 12 is driven to rotate by an axis 13 with its outer circumferential surface contacted with an inner circumferential surface of the printing drum 10. A cam 24 is attached to the annular member 16 in the vicinity of the connecting member 18. An annular cam-follower 23 provided on the axis 13 engages with the cam 24. Thus, when the ink supplying roller 12 passes the connecting member 18 during the drum rotation, the roller 12 is lifted up from the inner circumferential surface of the printing drum 10 so that collisional contact of the roller with the connecting member can be avoided.

On the back-pressing roller 14, a clamp 25 is attached to a rear portion of the traverse groove 22 relative to the rotating direction of the back-pressing roller. The clamp 25 holds a leading end of a printing sheet on the back-pressing roller 14. The printing sheet is attached to the back-pressing roller 14 with its leading end held by the. clamp 25. The printing sheet is inserted between the back-pressing roller 14 and the printing drum 10 during the clockwise rotation of the back-pressing roller 14 as shown in the drawing. Ink is provided to the inside of the flexible porous sheet 20 by the ink supplying roller 12, and passes through holes formed in the ink supplying roller 12, thereby transferring to the printing sheet through perforations of the stencil sheet 19 to form an image thereon.

In Japanese Patent Application 5-306033 (Japanese Laid Open Publication No. 7-137419), there disclosed such a stencil printing machine that incorporates a head-and-tail adjusting device for adjusting a position of an printed image on a printing sheet. In such stencil printing machine, when a rotational phase of the printing drum 10 relative to the back-pressing roller 14 is in a standard condition, a border line 26 dividing the porous structure 20*c* and the non-porous front edge 20*a* of the flexible porous sheet corresponds to a line 28 on the outer circumferential surface of the back-pressing roller 14. Similarly, a borderline 32 dividing the porous structure 20*c* and the rear edge 20*b* of the flexible porous sheet corresponds to a line 34 on the outer circumferential surface of the back-pressing roller 14. When a rotational phase of the printing drum 10 relative to the back-pressing roller 14 is changed for head and tail adjustment, the lines 28 and 34 move in the directions shown by arrows 38 and 40, respectively, and the porous structure 20*c* may meet the clamp 25.

As illustrated in FIG. 19, rather large recess 27 is formed in the rear side of the clamp 25, so that the clamp 25 can lean in pivotally moving around an axis 62. Then, suppose that the porous structure 20*c* of the flexible porous sheet meets the clamp 25, as stated above. Ink is pressed by the ink supplying roller 12 against a part of an inner surface of the porous structure 20*c* corresponding to the recess 27. Ink is squeezed out into the inside of the stencil sheet 19 through holes of the porous structure 20*c*, but the ink is not fully supported by the stencil sheet on the outside. Accordingly, as illustrated in FIG. 19, a part of the stencil sheet 19 corresponding to the recess 27 swells locally. Once ink is squeezed out in this way, since it has high viscosity, all of the squeezed ink cannot return to the inside of the porous structure 20*c* even after releasing of the ink-pressing force. Thus, if such phenomenon is repeated during rotation of the printing drum, ink flows across the porous structure 20*c* from the inside to the outside of the printing drum, thereby accumulating between the outer circumferential surface of the printing drum and the stencil sheet. And, it is clear from FIG. 19 that such ink-leakage due to shortage of back-pressing at the recess 27 similarly occurs in a stencil printing machine having a rigid porous structure. Accumulation of the ink leads to ink-leakage at both axial end portions of the printing drum. Further accumulation of the ink may force the swelled stencil sheet to be strongly pressed against the clamp 25 or a corner of the recess 27, thereby causing damage to the sheet.

An invention shown in FIG. 20 has been proposed by the present applicant in Japanese Patent Application 7-214075 (Japanese Laid Open Publication No. 9-39359) in order to settle such problem. The drawing shows a strip-shaped elastic sheet 52 situated on the outer circumferential surface of the back-pressing roller 14 along a generating line for covering the clamp 25.

The problem is settled to some extent by the strip-shaped elastic sheet 52. However, since the elastic sheet 52 easily bend, if the machine operates for a long time while the porous structure 20*c* of the flexible porous sheet repeatedly contacts the clamp 25, ink-leakage due to deformation of the elastic sheet 52 may occur through the ink-leakage process explained in referring to FIG. 19.

Then, the present applicant improved the stencil printing machine and proposed a new one as shown in FIGS. 10 to 17 in Japanese Patent Application 9-183113 to further reliably prevent the ink-leakage by the leakage process explained above.

As illustrated in FIG. 10 and FIG. 16, the back-pressing roller 14 is driven to rotate around an axis 68. The axis 68 is attached to a predetermined position of a non-illustrated frame. The back-pressing roller 14 is driven to rotate around the axis 68.

Plural clamps 25 are disposed on the back-pressing roller 14. The back-pressing roller 14 has the axis 62. The plural clamps 25 are fixed to the axis 62 at a predetermined distance therebetween. One end of the arm 101 is fixed to one end portion of the axis 62. A driven member 102 is attached to the other end of the arm 101. A cam 100 is adjacent to one end of the back-pressing roller 14 and fixed to the not-shown frame of the back-pressing roller 14. The arm 101, the driven member 102, and the cam 100 are arranged on the distant end side in the perspective view of FIG. 16.

The driven member 102 engages with the cam 100. The cam 100 is fixed to the frame. The driven member 102 follows the cam 100 while rotating with the back-pressing roller 14. The outer shape of the cam 100 enables the clamp 25 to open or close at appropriate timing in synchronization with rotation of the back-pressing roller 14.

An arm 70 in the shape of L is rotatably connected to the axis 68 at an elbow-portion thereof. One end of the arm 70 is connected to a link 84. The link 84 is connected to one end of the axis 62 via a link 64. The other end of the axis 62 is connected to the arm 101. A clamp cover 66 is rotatably connected to the other end of the arm 70 via a connecting axis 74. The clamp cover 66 is a member that covers gaps between the clamps 25 arranged at intervals and the recess 27 formed in the back-pressing roller 14 at a rear end side of the clamps 25. As illustrated in FIG. 16, a bracket 80 is fixed to an end surface of the back-pressing roller 14. A link 78 is rotatably connected to the bracket 80 via a pin 82. A pin 76 is fixed to an end portion of the clamp cover 66. The pin 76 is rotatably connected to the link 78 while passing through a groove 103 formed in the other end of the arm 70.

Operation in the constitution explained above will be explained. The back-pressing roller 14 is driven to rotate. The cam 100 remains static since it is fixed to the frame side. The driven member 102 connected to the back-pressing member 14 follows the shape of the cam 100 while rotating around the axis 68. The movement of the driven member 102 causes the axis 62 to rotate, thereby opening or closing the clamp 25. The rotation of the axis 62 causes arm 70 to rotate, and the clamp cover 66 connected to the arm 70 moves while being regulated by the link 78.

In a predetermined timing at which a printing sheet is supplied between the back-pressing roller 14 and the printing drum, the driven member 102 starts to contact and follow the cam 100, as illustrated in FIG. 11. The axis 62 rotates, thereby causing the clamp 25 to open. Simultaneously with this movement, the clamp cover 66 is slightly lifted up while moving backward from an initial position adjacent to the clamp 25.

As illustrated in FIG. 12, the driven member 102 continuously follows the cam 100 while further being lifted up as the clamp 25 opens more broader. The clamp cover 66 slightly descends while moving further backward from the clamp 25.

As illustrated in FIG. 13, the driven member 102 reaches the topmost position of the cam 100. The clamp 25 opens broadest. The clamp cover 66 descends still further.

As illustrated in FIG. 14, when the driven member 102 reaches a recess portion of the cam 100, the axis 62 begins to rotate in the other direction wherein the clamp 25 closes. Simultaneously with this movement, the clamp cover 66 switches from descending to ascending.

As illustrated in FIG. 15, when the driven member 102 follows the recess portion of the cam 100, the clamp 25 further closes and the clamp cover 66 moves back to the clamp 25 while ascending. And, the clamp 25 and the clamp cover 66 return to the initial position as shown in FIG. 10.

In the above-explained operation of the stencil printing machine proposed in Japanese Patent Application 9-183113, a front end of the clamp cover 66 describes a line (A) as shown in FIG. 17 when the clamp cover 66 opens and closes. The clamp cover 66 is connected to the other end of the arm 70 rotating around the axis 68, and the movement of the other end of the arm 70 is regulated by the link 78 pivotally movable around the pin 82. Accordingly, the clamp cover 66 describes a curved line both in opening and closing, and the curved lines in opening and closing coincide with each other.

In the constitution utilizing such link-mechanism, when the clamp 66 opens and closes, it makes large impulsive sound, which has been desired to be reduced.

An object of the present invention is to provide a stencil printing machine capable of surely preventing the ink-leakage and reducing the impulsive sound when the clamp cover opens and closes.

SUMMARY OF THE INVENTION

A stencil printing machine as defined in the first aspect of the present invention comprises a printing drum having a flexible ink-permeable circumferential wall adapted to receive a perforated stencil sheet around an outer circumferential surface thereof, the printing drum being driven to rotate around a central axis thereof; pressing means situated inside the printing drum for supplying ink to an inner surface of the circumferential wall, the pressing means being movable between a pressing position for pressing the circumferential wall to be deformed radially outwardly and a standing position for releasing the circumferential wall from deformation; an opposing drum disposed adjacent to the printing drum and driven to rotate in a direction opposite to that of the printing drum; a clamp disposed on an outer circumferential surface of the opposing drum and operating in synchronization with rotation of said the drum to hold a leading edge of a printing sheet supplied between the printing drum and the opposing drum; a clamp cover disposed on the outer circumferential surface of the opposing drum adjacent to the clamp relative to the direction of rotation of the opposing drum and covering the recess formed in the opposing drum for allowing operation of the clamp, the clamp cover selectively opening and closing the recess in synchronization with operation of the clamp; and driving mechanism for driving the clamp cover to move alternately in a circumferential direction and a radial direction of the opposing drum.

A stencil printing machine as defined in the second aspect of the present invention comprises a printing drum having a flexible ink-permeable circumferential wall adapted to receive a perforated stencil sheet around an outer circumferential surface thereof; the printing drum being driven to rotate around a central axis thereof; pressing means situated inside the printing drum for supplying ink to an inner surface of the circumferential wall, the pressing means being movable between a pressing position for pressing the circumferential wall to be deformed radially outwardly and a standing position for releasing the circumferential wall from deformation; an opposing drum disposed adjacent to the printing drum and driven to rotate in a direction opposite to that of the printing drum; a recess formed in an outer circumferential surface of the opposing drum; a clamp having a rotational axis extending parallel to a central axis of the opposing drum and disposed adjacent to the recess and a plate member attached to the rotational axis, the clamp holding a leading edge of a printing sheet supplied between the printing drum and the opposing drum; a clamp cover disposed on the outer circumferential surface of the opposing drum at a rear side of the clamp relative to a direction of rotation of the opposing drum for covering the recess so as to be movable in a circumferential direction and a radial direction of the opposing drum; a clamp driving mechanism attached to the opposing drum for driving the clamp to open and close in synchronization with the rotation of the opposing drum; a circumferential movement mechanism disposed to the opposing drum for moving the clamp cover in a circumferential direction of the opposing drum in synchronization with the rotation of the opposing drum; and a radial movement mechanism disposed to the opposing drum for moving the clamp cover in a radial direction of the opposing drum in synchronization with the rotation of the opposing drum so that when the clamp opens, the clamp cover departs from the clamp in the circumferential direction and then moves radially outwardly of the opposing drum, and when the clamp closes, the clamp cover approaches the clamp in the circumferential direction and then moves radially inwardly of the opposing drum to cover the recess.

A stencil printing machine as defined in the third aspect of the present invention comprises a printing drum having a flexible ink-permeable circumferential wall adapted to receive a perforated stencil sheet around an outer circumferential surface thereof, the printing drum being driven to rotate around a central axis thereof, pressing means situated inside the printing drum for supplying ink to an inner surface of the circumferential wall, the pressing means being movable between a pressing position for pressing the circumferential wall to be deformed radially outwardly and a standing position for releasing the circumferential wall from deformation; an opposing drum disposed adjacent to the printing drum and driven to rotate in a direction opposite to that of the printing drum; a recess formed in an outer circumferential surface of the opposing drum; a clamp having a rotational axis extending parallel to a central axis of the opposing drum and disposed adjacent to the recess and a plate member attached to the rotational axis, the clamp holding a leading edge of a printing sheet supplied between the printing drum and the opposing drum; a clamp driving mechanism having a first arm connected to the rotational axis, a first driven member attached to the first arm, and a first cam for rotating the rotational axis by moving the first driven member upon rotation of the opposing drum so that the clamp opens and closes alternately in synchronization with the rotation of the opposing drum; a clamp cover disposed on the outer circumferential surface of the opposing drum at a rear side of the clamp relative to a direction of rotation of the opposing drum for covering the recess so as to be movable in a circumferential direction and a radial direction of the opposing drum; a circumferential movement mechanism having a second arm, the second arm being rotatable around a central axis of the opposing drum and including one end portion connected to the clamp driving mechanism and the other end portion rotatably connected to the clamp cover with a connecting axis so that the clamp cover moves in the circumferential direction of the opposing drum when the clamp opens and closes; and a radial movement mechanism having a third arm rotatably connected to the connecting axis and connected to the clamp cover, a second driven member attached to an end of the third arm, and a second cam for driving the clamp cover to rotate around the connecting axis by moving the second driven member upon rotation of the opposing drum so that the clamp cover moves in the radial direction of the opposing drum when the second arm rotates around the central axis of the opposing drum while the clamp opens and closes, the clamp cover departing from the clamp in the circumferential direction when the clamp opens and next moves radially outwardly of the opposing drum, and approaching the clamp in the circumferential direction when the clamp closes and next moves radially inwardly of the opposing drum to cover the recess.

A stencil printing machine as defined in the fourth aspect of the present invention further comprises urging means for urging the third arm so that the clamp cover is urged to move radially inwardly of the opposing drum in the third aspect.

According to a stencil printing machine as defined in the fifth aspect of the present invention, in the stencil printing machine of the third aspect, the second arm includes a hole at the other end portion thereof, and the third arm is connected to the clamp cover with a connecting member inserted through the hole.

According to a stencil printing machine as defined in the sixth aspect of the present invention, in the stencil printing machine of the third aspect, the stencil printing machine further comprises a frame for supporting the central axis of the opposing drum, and the first cam and the second cam are coaxially fixed to the frame on the central axis while pinching the opposing drum.

DETAILED DESCRIPTION OF PREFERRED EMBODIMENTS

One embodiment of the present invention will be explained referring to FIGS. 1 to 9. In the embodiment, a driving mechanism for moving a clamp cover in an opposing drum as a back-pressing roller will be mainly explained. The opposing drum explained in the embodiment is a part of a stencil printing machine having a printing drum and so on. Structure and its operation not explained herein are approximately identical to those of the related art.

Figure 1:
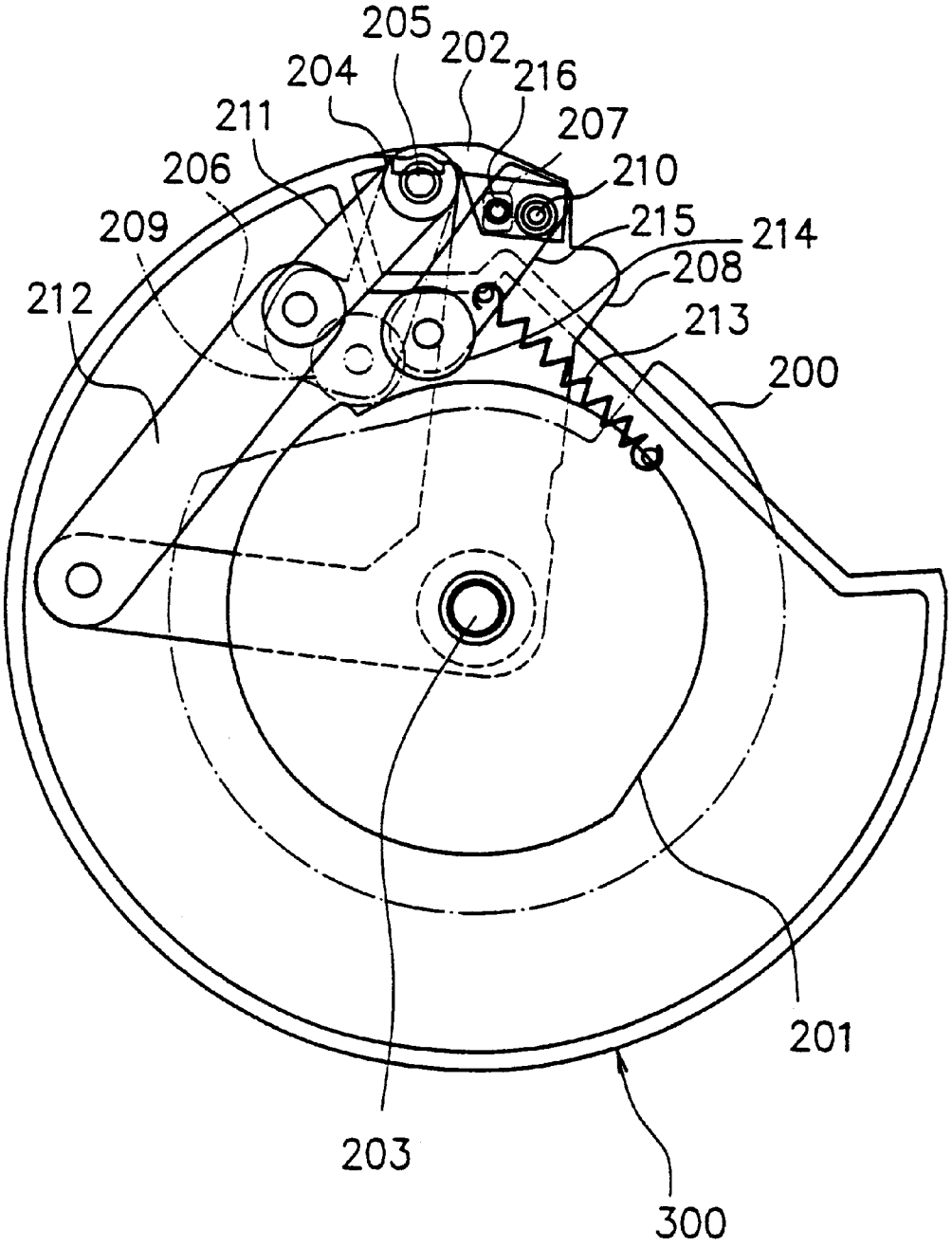
FIG. 1 is one side view of a printing drum in one embodiment of the present invention.
Figure 2:
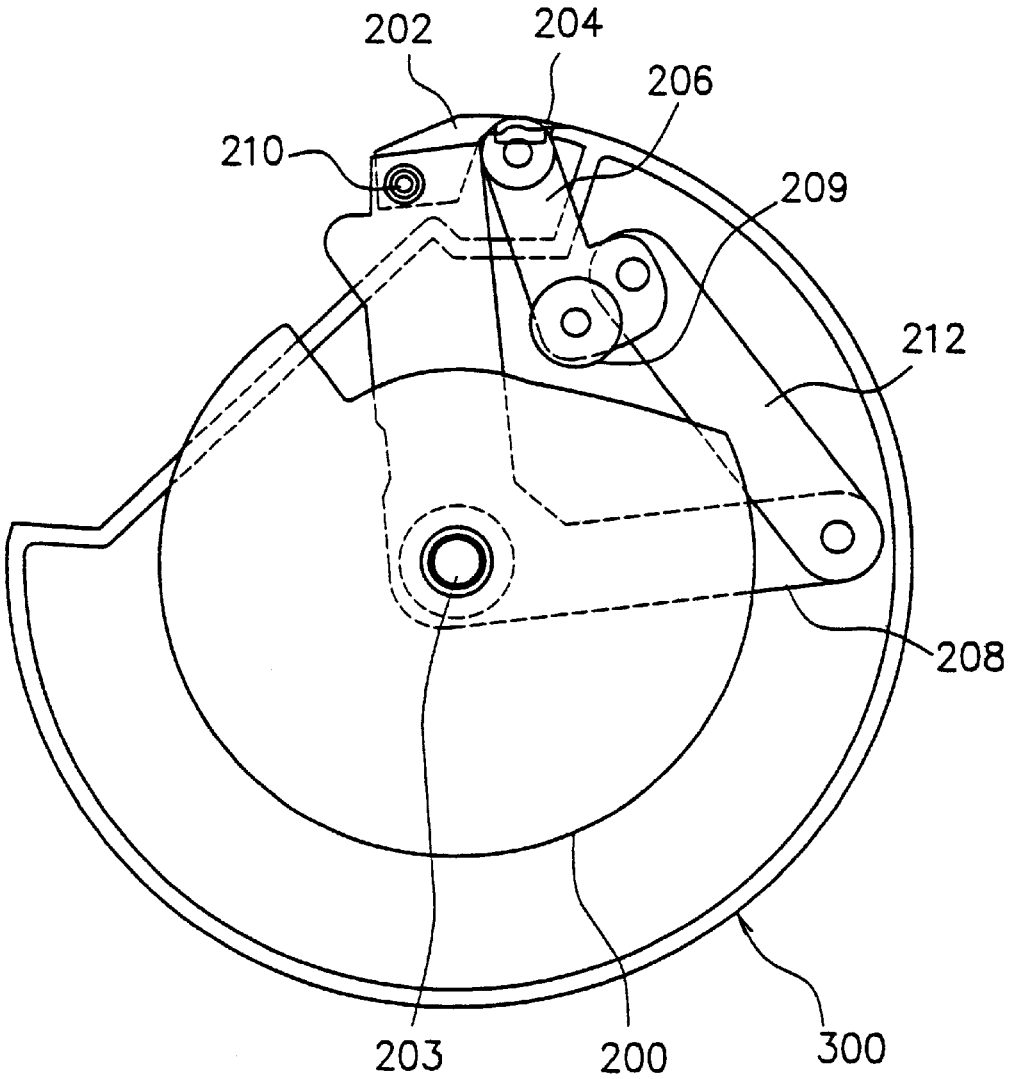
FIG. 2 is the other side view opposite to FIG. 1 illustrating the printing drum.
Figure 8:
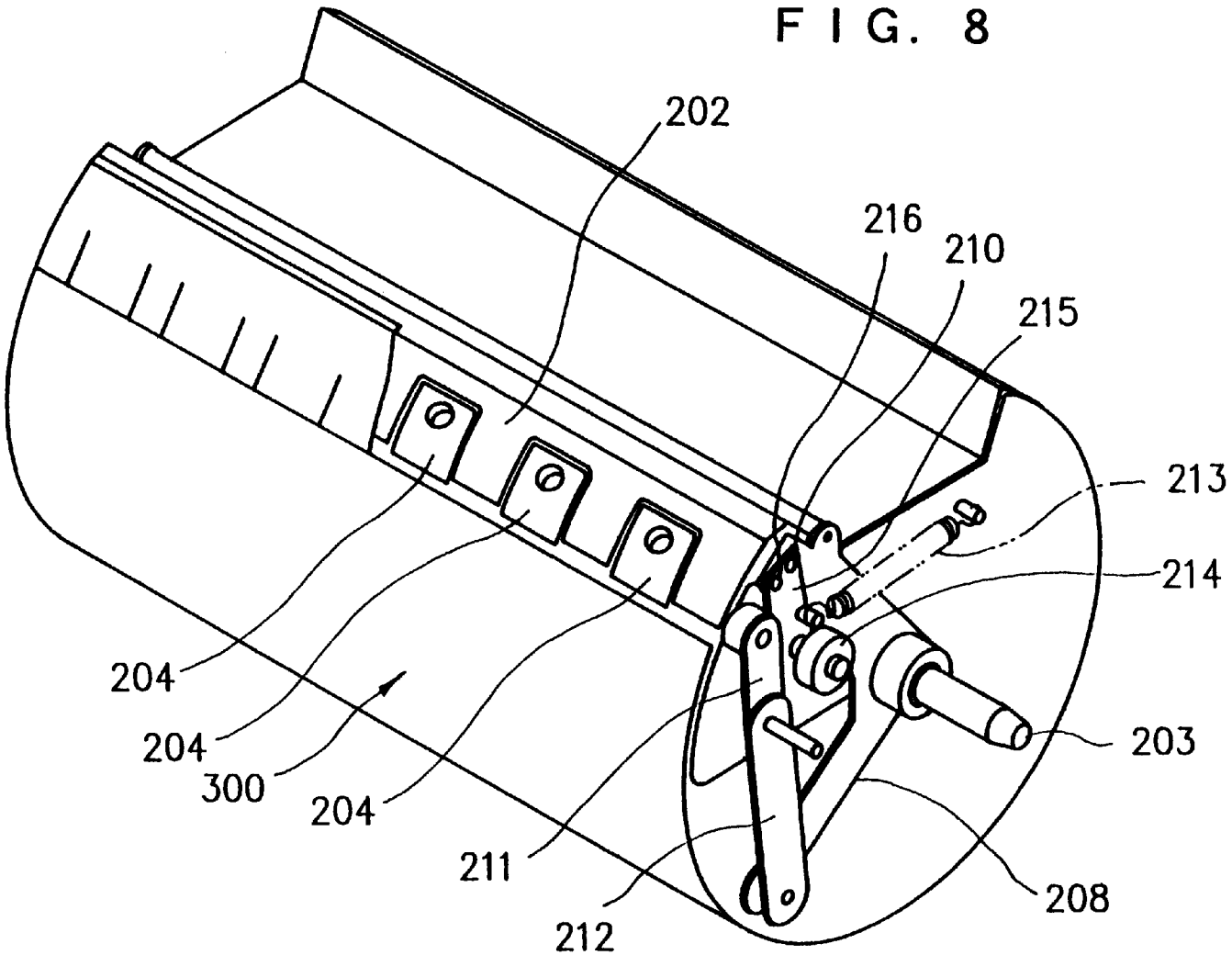
FIG. 8 is a perspective view illustrating the printing drum in the embodiment of the present invention.

Referring to FIGS. 1, 2, and 8, structure of a paper roller 300 as the back-pressing roller will be explained.

Plural clamps 204 are disposed on the opposing drum 300. A mechanism for opening and closing the clamp 204 will be explained.

The opposing drum 300 has an axis 205. The plural clamps 204 are fixed to the axis 205 at a predetermined distance therebetween. One end of an arm 206 is fixed to one end portion of the axis 205. A driven member 209 is attached to the other end of the arm 206. A cam 200 is adjacent to one end of the opposing drum 300 and fixed to a not-shown frame of the opposing drum 300. The arm 206, the driven member 209, and the cam 200 are arranged on the distant end-face side in the perspective view of FIG. 8.

The driven member 209 engages with the cam 200. The cam 200 is fixed to the frame. The driven member 209 follows the cam 200 while rotating with the opposing drum 300. The outer shape of the cam 200 enables the clamp 204 to open or close at appropriate timing in synchronization with rotation of the opposing drum 300.

A clamp cover 202 is disposed on the opposing drum 300. The clamp cover 202 is a member that covers gaps between the clamps 204 arranged at intervals and a recess formed in the opposing drum 300 at a rear side of the clamps 204.

A circumferential movement mechanism will be explained. The mechanism is for moving the clamp cover in a circumferential direction of the opposing drum 300. An arm 208 in the shape of L is rotatably connected to the axis 203 at an elbow-portion thereof One end of the arm 208 is connected to a link 212. The link 212 is connected to one end of the axis 205 via a link 211. The other end of the axis 205 is connected to an arm 206. A driven member 209 is rotatably supported on the arm 206. The clamp cover 202 is rotatably connected to the other end of the arm 208 via a connecting axis 210.

Movement of the clamp 204 makes the arm 208 swing around the axis 203 via the link 211 and the link 212. The clamp cover 202 attached to the arm 208 moves in the circumferential direction of the opposing drum 300 around the axis 203.

A radial movement mechanism will be explained. The mechanism is for moving the clamp cover in a radial direction of the opposing drum 300. A connecting axis 210 is connected to the other end of the arm 208. An arm 215 is rotatably connected to the connecting axis 210 at one end thereof. A driven member 214 is rotatably attached to the other end of the arm 215. A cam 201 is adjacent to the other end of the opposing drum 300 and fixed to the not-shown frame of the opposing drum 300. The arm 215, the driven member 214, and the cam 201 are arranged on the near end-face side in the perspective view of FIG. 8.

The driven member 214 engages with the cam 201. The cam 201 is fixed to the frame. The driven member 214 follows the cam 201 while rotating with the opposing drum 300. The outer shape of the cam 201 enables the clamp cover 202 to move in the radial direction of the opposing drum 300 at appropriate timing in synchronization with rotation of the opposing drum 300.

A pin 216 is fixed to an end portion of the clamp cover 202. The pin 216 is connected to the arm 215 while passing through a groove 207 formed in the other end of the arm 280. The arm 215 is connected to the end face of the opposing drum 300 by a spring 213 as urging means. Thus, the arm 215 is always urged by the spring 213 to rotate anticlockwise around the connecting axis 210 in FIG. 1. Accordingly, the clamp cover 202 is urged to move inward in the radial direction of the opposing drum 300.

Operation of the clamp and the clamp cover in the above-explained constitution will be explained.

(1) Operation of the clamp 204

The opposing drum 300 is driven to rotate. The cam 200 remains static since it is fixed to the frame side. The driven member 209 connected to the opposing drum 300 follows the shape of the cam 200 while rotating around the axis 203. The movement of the driven member 209 connected to the arm 206 causes the axis 205 to rotate, thereby opening or closing the clamp 204.

(2) Operation of the clamp cover 202

Operation of the clamp cover 202 is composed of a circumferential movement in the circumferential direction of the opposing drum 300, namely a rotational movement around the axis 203, and a radial movement in the radial direction of the opposing drum 300, namely a rotational movement around the axis 210.

The circumferential movement of the clamp cover 202 is to be effected as follows. When the driven member 209 is lifted up by the cam 200, the axis 205 is driven to rotate. The rotational movement of the axis 205 is converted into the rotational movement of the clamp cover 202 around the axis 203 by the link 211, the link 212, and the L-shaped arm 208. Since the clamp cover 202 is urged by the spring, it remains closed radially inwardly over the opposing drum 300 if the driven member 214 is not lifted up by the cam 201. In FIG. 1, a circumferential surface of the driven member 214 is distant from a circumferential surface of the cam 201 by a very small gap.

The radial movement of the clamp cover 202 in the radial direction of the opposing drum 300, namely a rotational movement around the axis 210, is effected only by the cam 201 and the driven member 214 engaged with each other. When the driven member 214 is lifted up by the cam 201, the arm 215 is driven to rotate clockwise in FIG. 1, and the clamp cover 202 moves to open.

Next, referring to FIGS. 1 to 7, consecutive movement of the clamp 204 and the clamp cover 202 will be explained.

Figure 9:
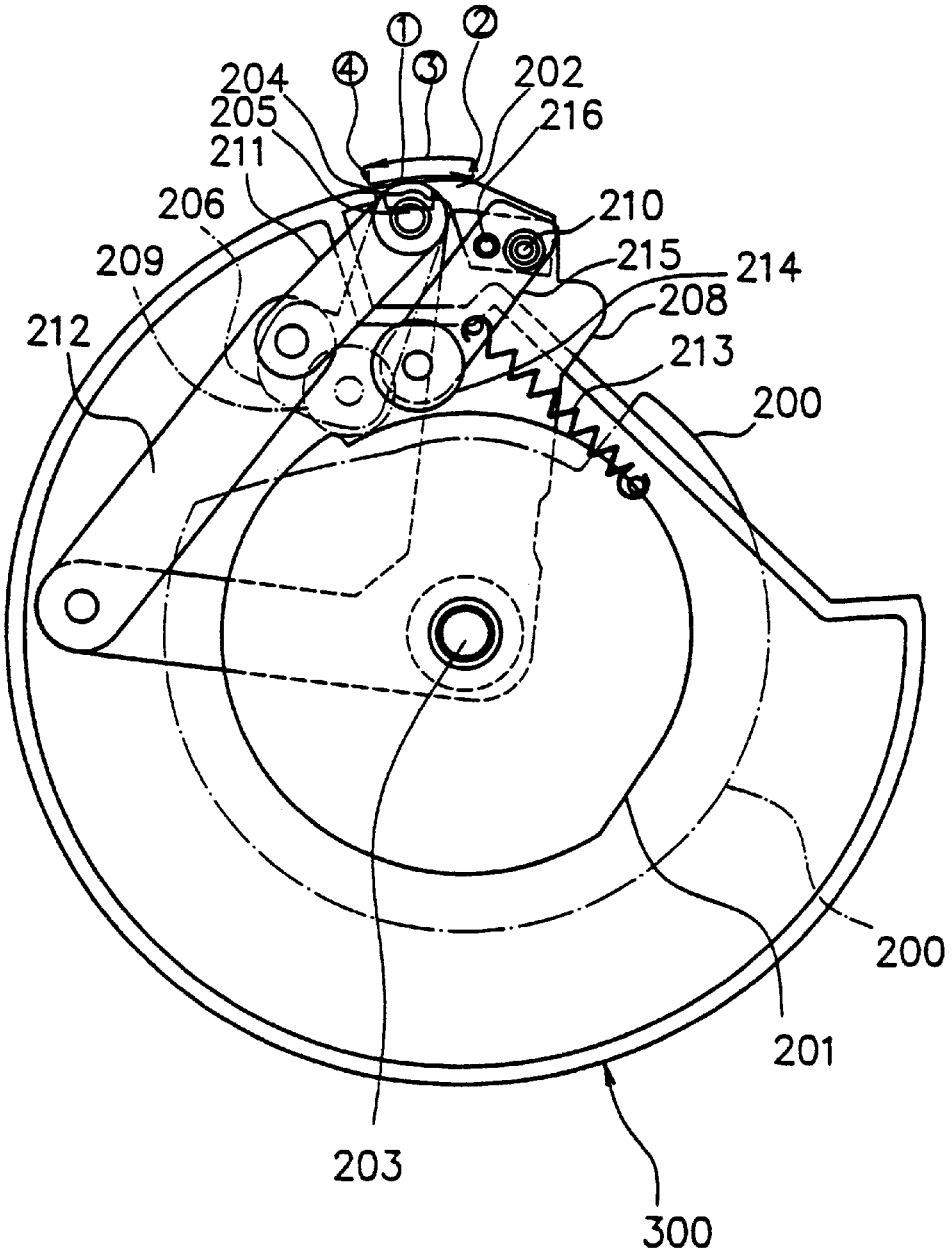
FIG. 9 is a side view illustrating the printing drum with lines described by the clamp cover in the embodiment of the present invention.
Figure 10:
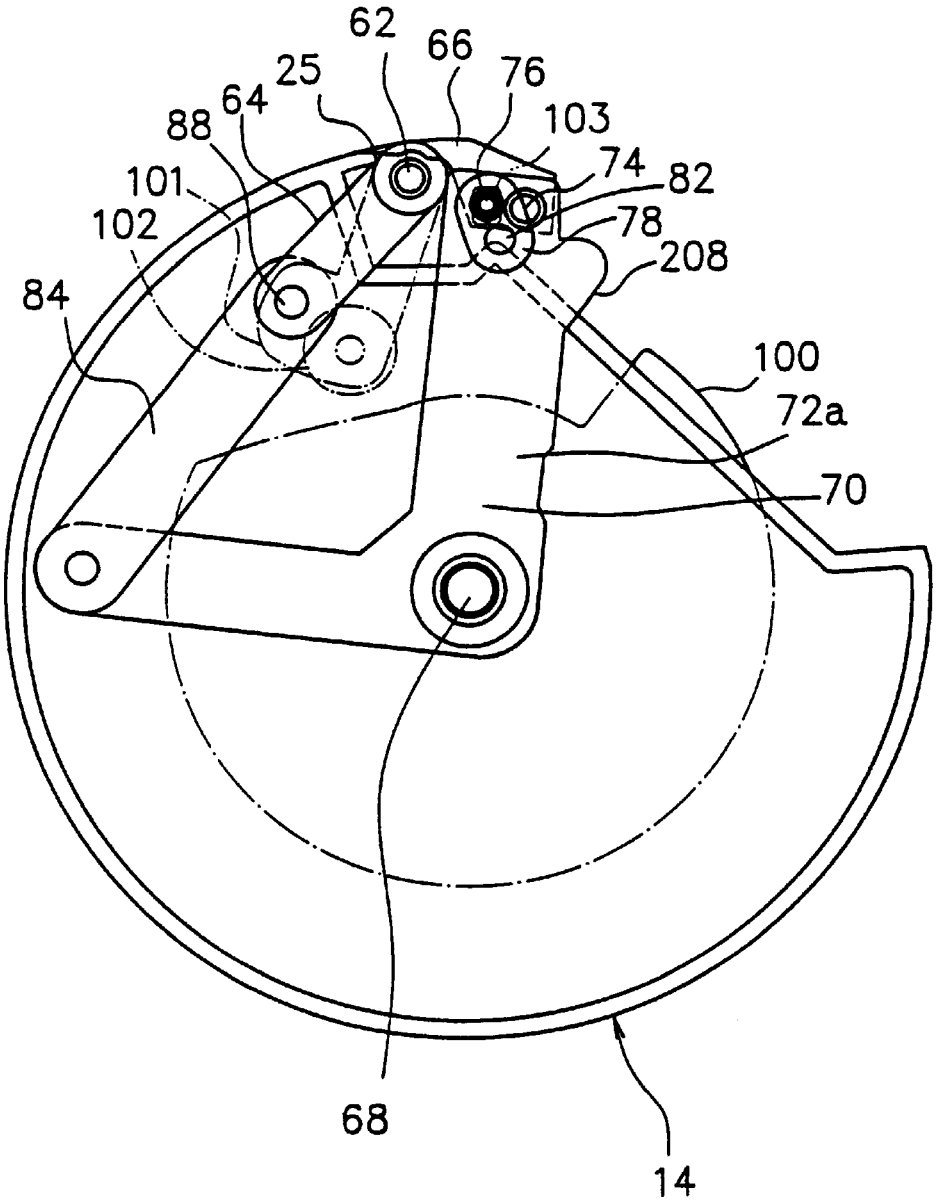
F I G. 10 Prior Art
FIG. 10 is a side view of a printing drum of a stencil printing machine previously proposed by the present applicant.
Figure 11:
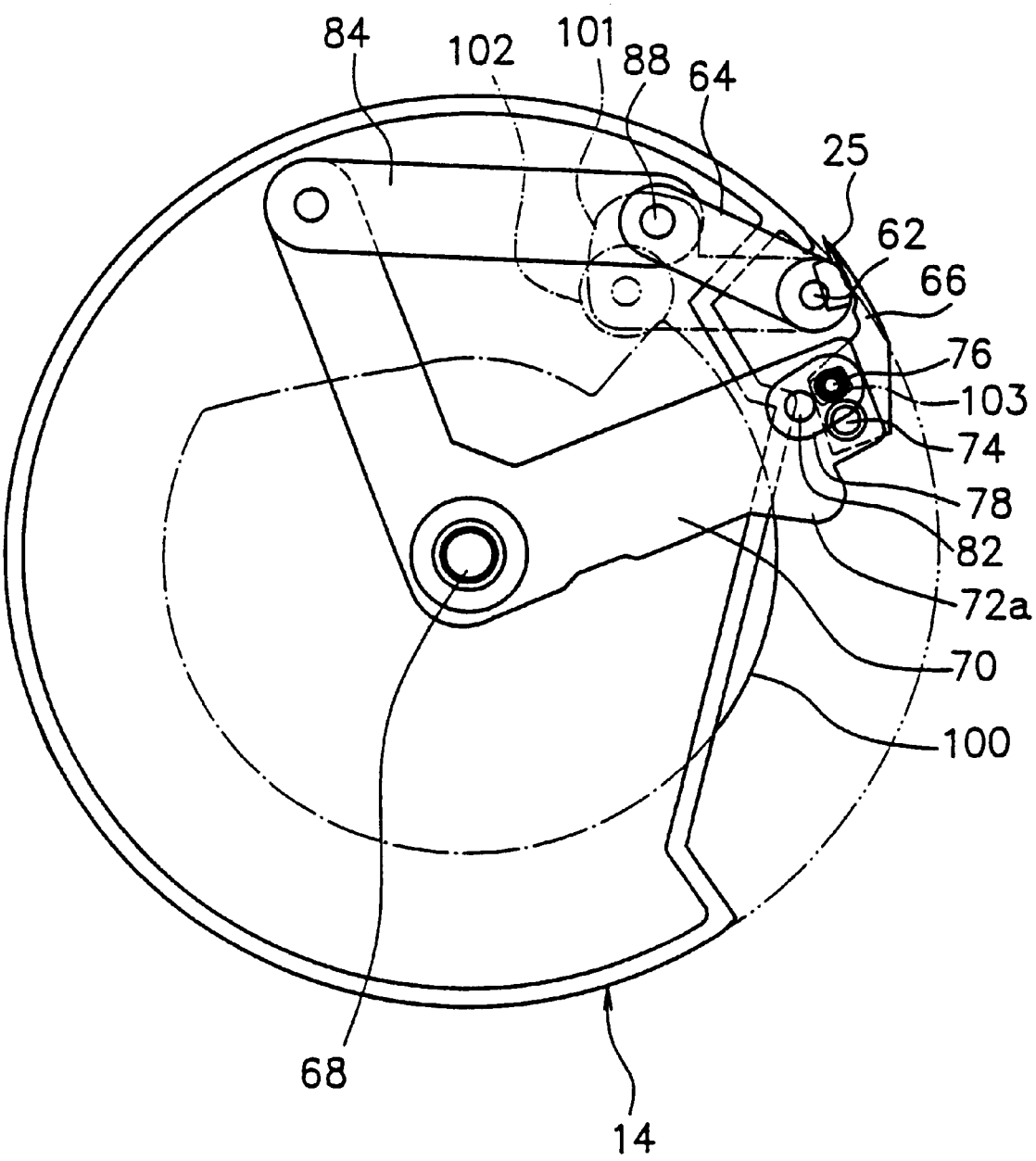
F I G. 11 Prior Art
FIG. 11 is a side view illustrating operation of the printing drum of the stencil printing machine previously proposed by the present applicant.
Figure 12:
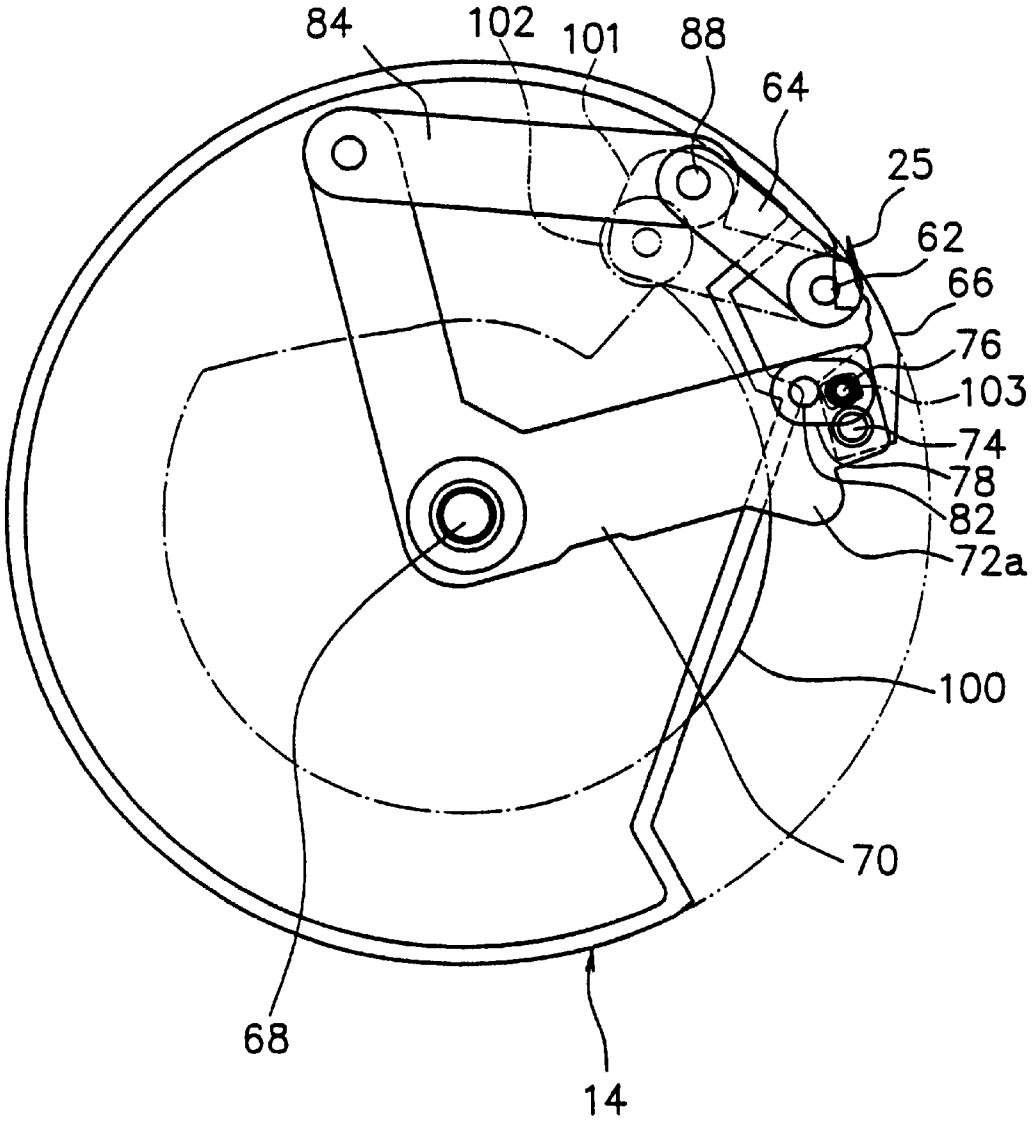
F I G. 12 Prior Art
FIG. 12 is a side view illustrating operation of the printing drum of the stencil printing machine previously proposed by the present applicant.
Figure 13:
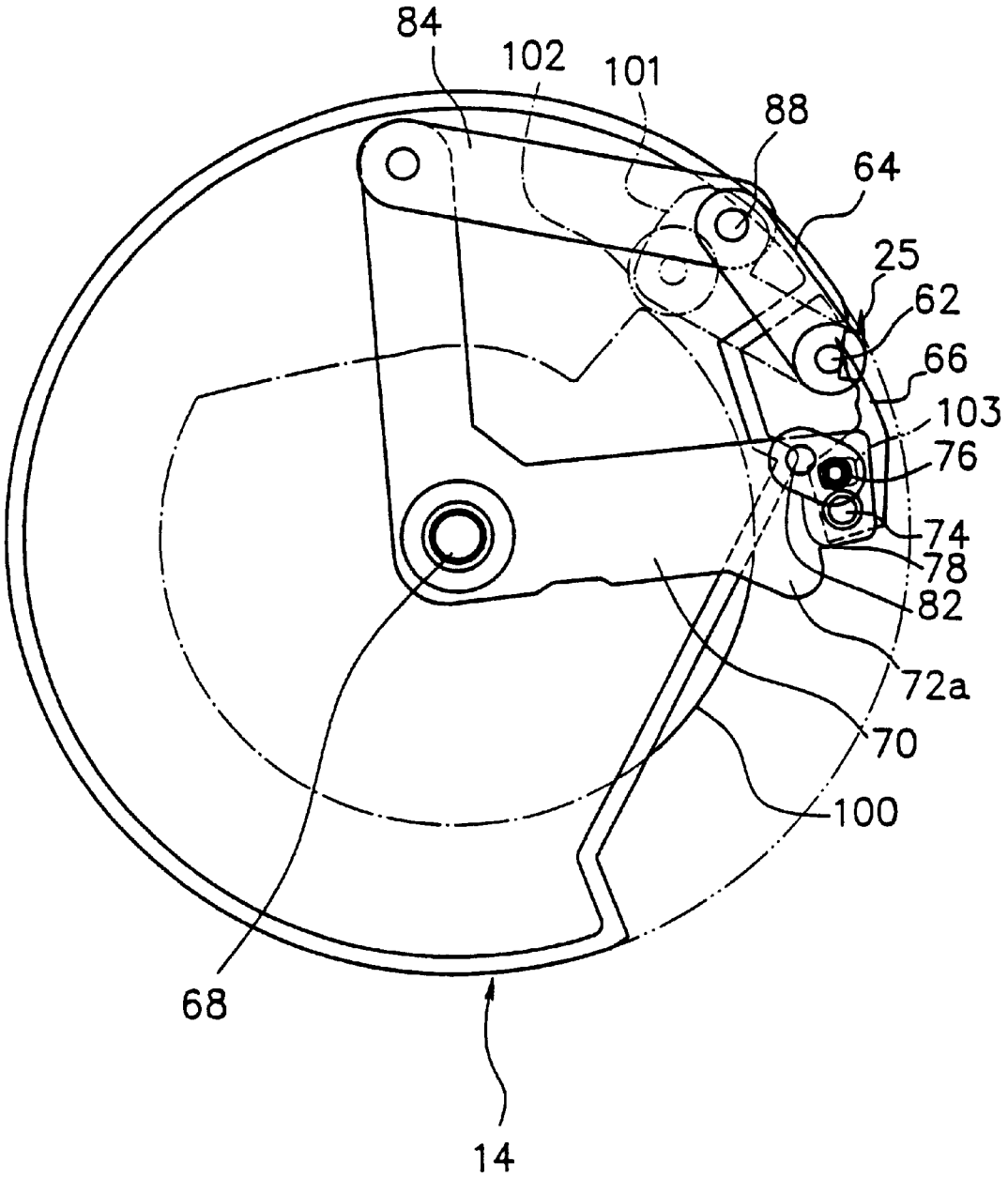
FIG. 13 Prior Art
FIG. 13 is a side view illustrating operation of the printing drum of the stencil printing machine previously proposed by the present applicant.
Figure 14:
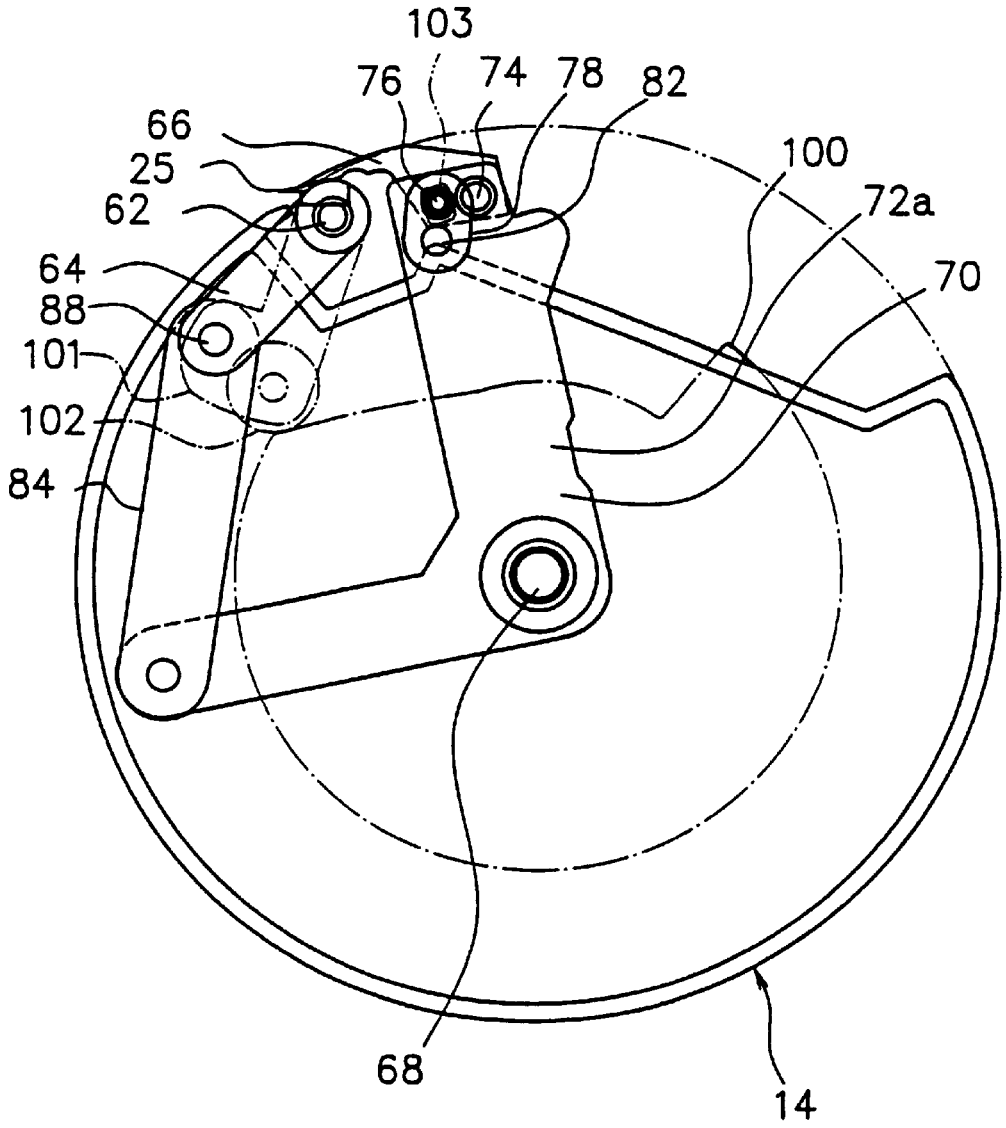
F I G. 14 Prior Art
FIG. 14 is a side view illustrating operation of the printing drum of the stencil printing machine previously proposed by the present applicant.
Figure 15:
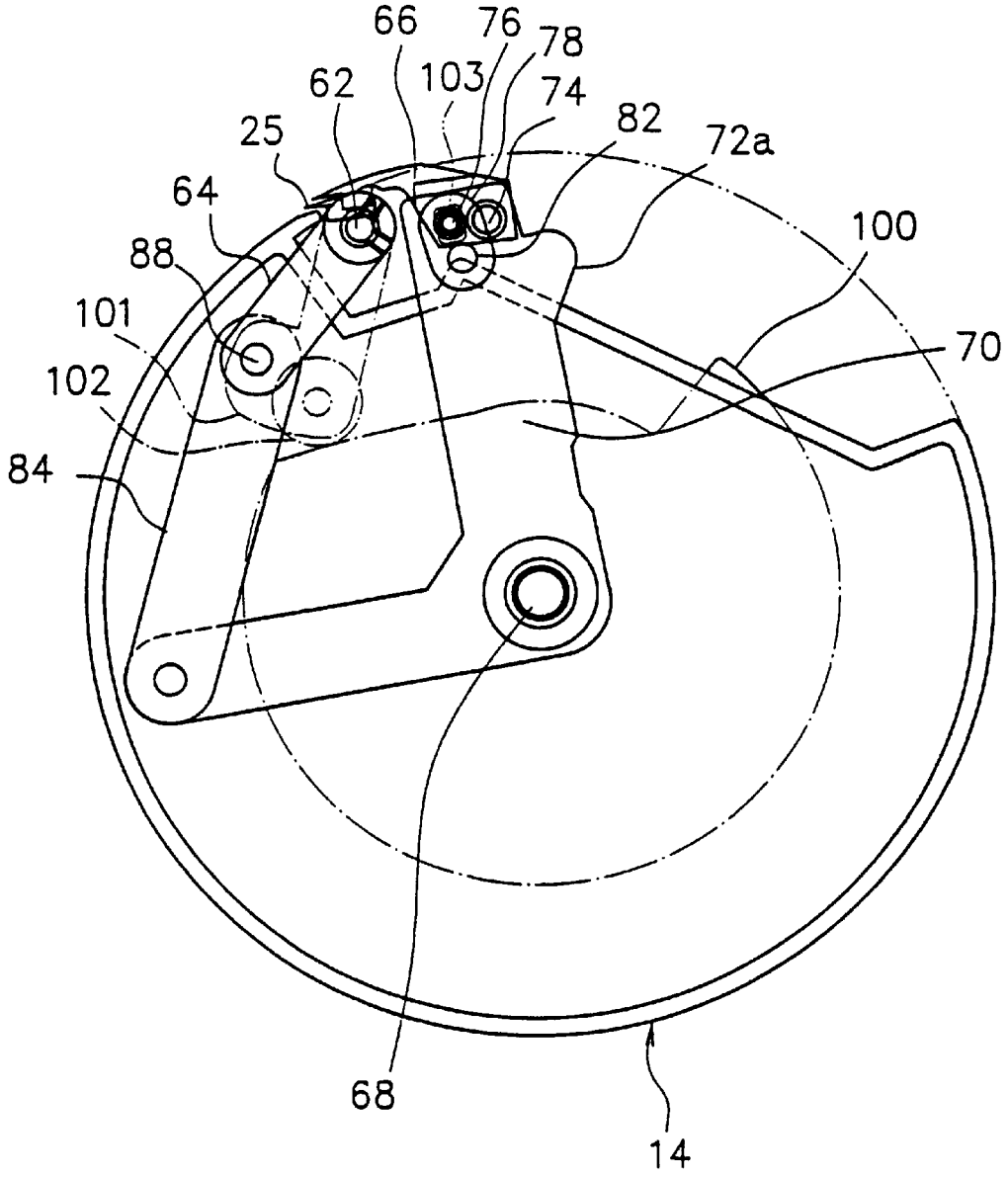
F I G. 15 Prior Art
FIG. 15 is a side view illustrating operation of the printing drum of the stencil printing machine previously proposed by the present applicant.
Figure 16:
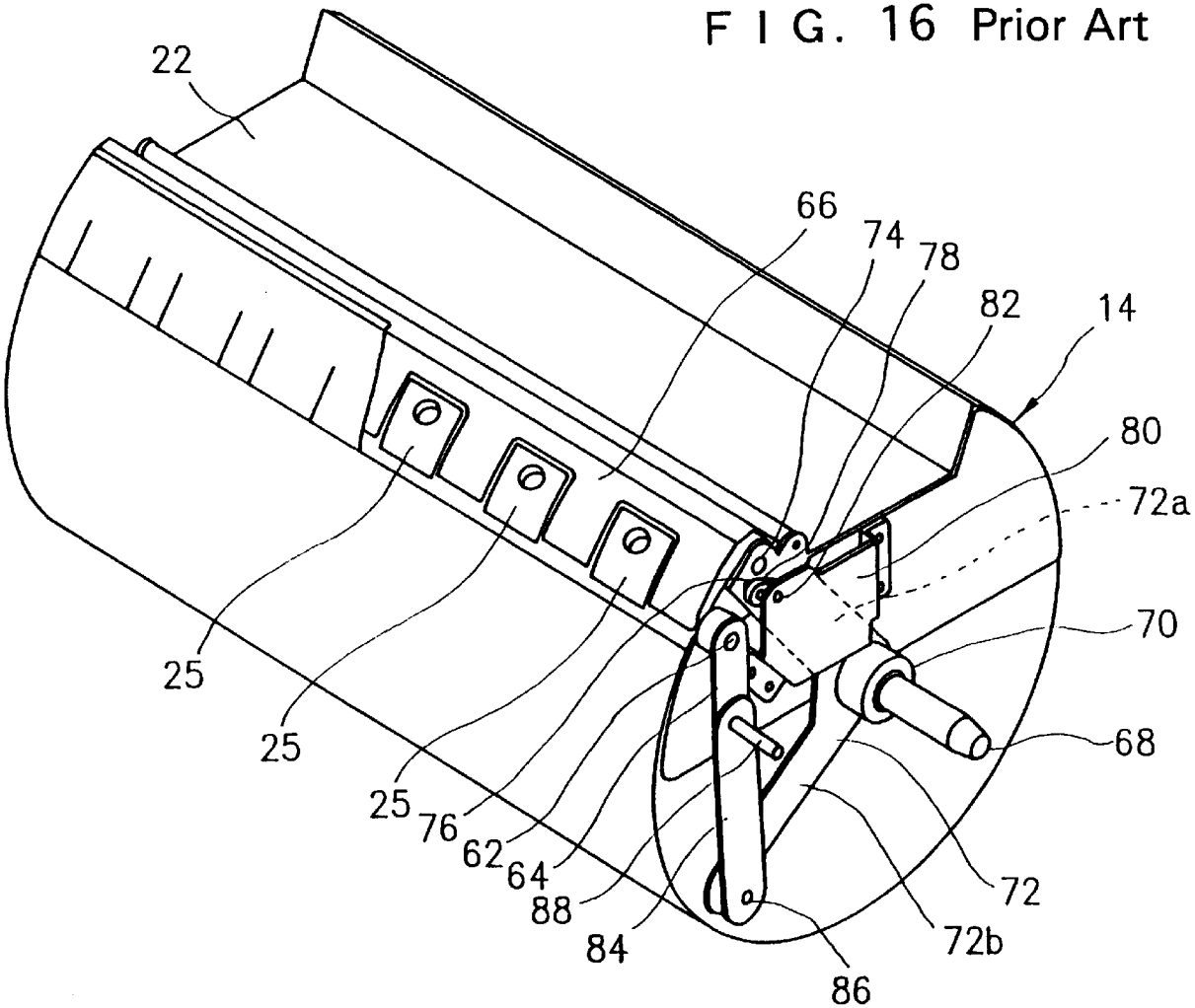
FIG. 16 Prior Art
FIG. 16 is a side view illustrating the printing drum of the stencil printing machine previously proposed by the present applicant.

In FIG. 9, the arrows (1) to (4) are lines described by a front end of the clamp cover 202 moving relative to the opposing drum 300. The clamp cover 202 opens in the circumferential direction of the opposing drum 300 as shown by the arrow (1), next opens in the radial direction of the opposing drum 300 as shown by the arrow (2), next closes in the circumferential direction while being opened in the radial direction as shown by the arrow (3), and closes in the radial direction as shown by the arrow (4). The consecutive movements shown by the arrows (1) to (4) effected in rotation of the opposing drum 300 will be explained referring to FIGS. 1 to 7.

In FIGS. 1 and 2, the clamp 204 and the clamp cover 202 are closed. FIGS. 3 to 7 illustrate consecutive rotating states of the opposing drum 300 starting from the state of FIG. 1.

Figure 3:
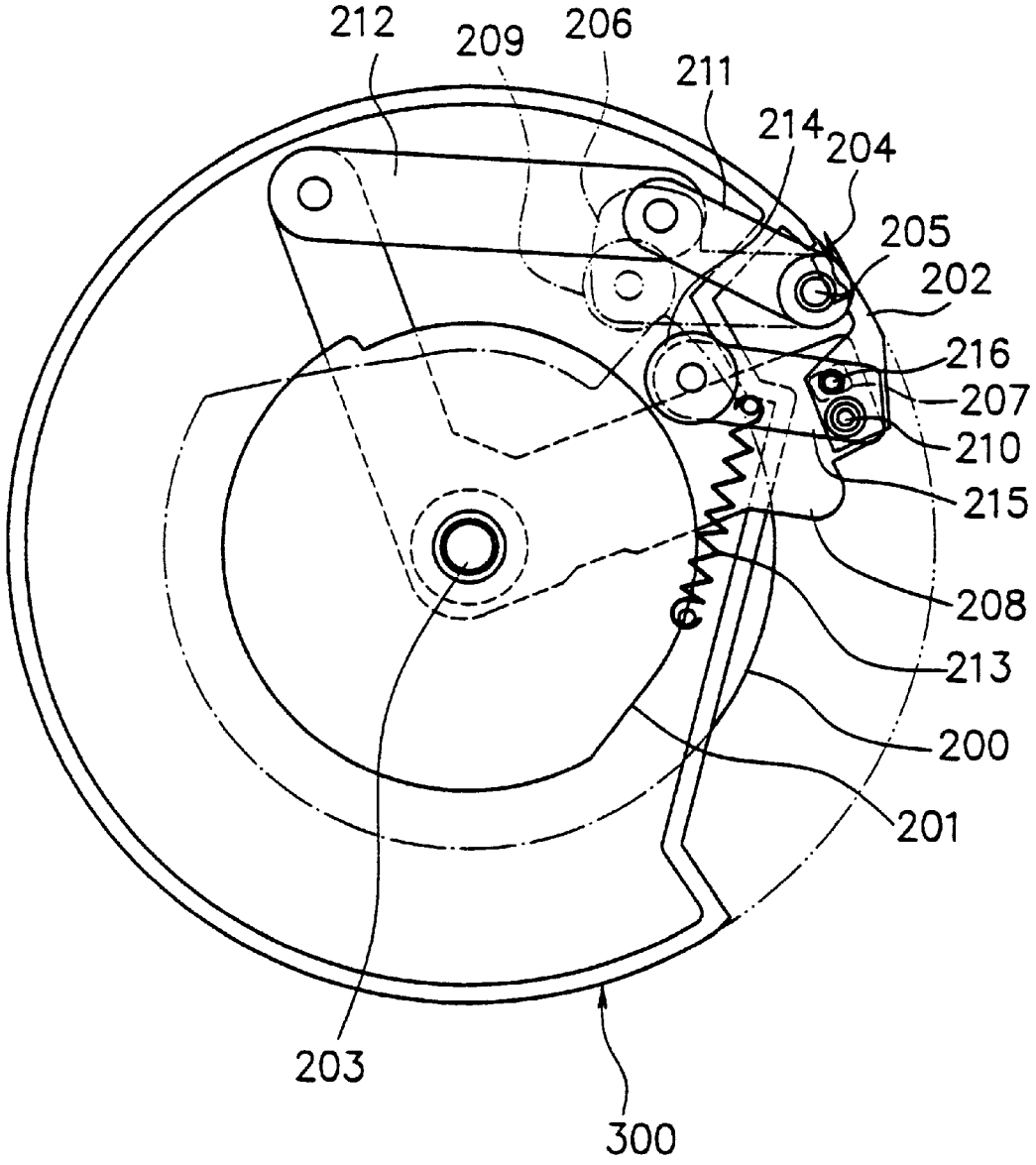
FIG. 3 is a side view illustrating operation of a clamp and a clamp cover in the embodiment of the present invention.
Figure 4:
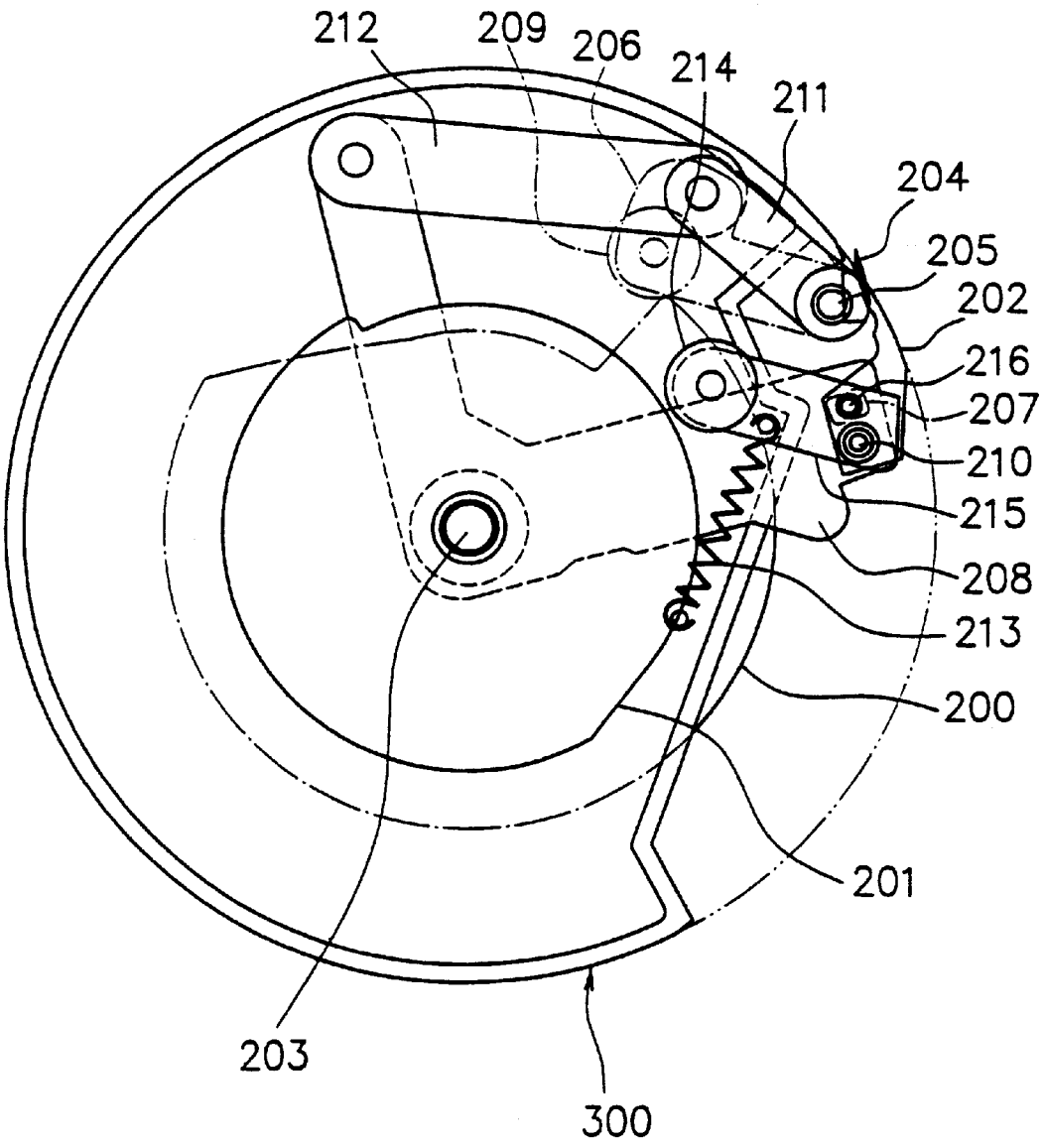
FIG. 4 is a side view illustrating operation of a clamp and a clamp cover in the embodiment of the present invention.
Figure 5:
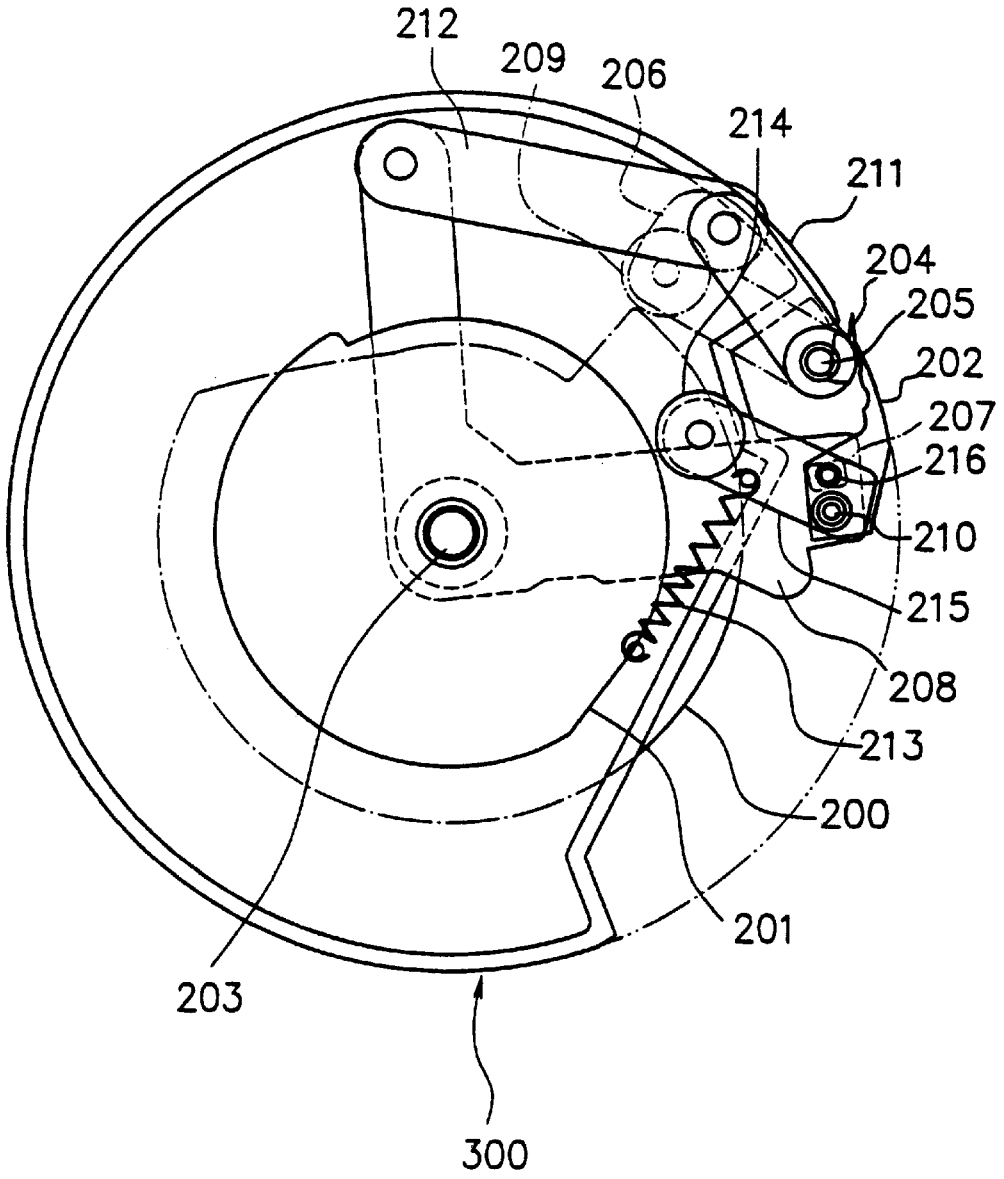
FIG. 5 is a side view illustrating operation of a clamp and a clamp cover in the embodiment of the present invention.

Next, FIGS. 3,4, and 5 correspond to the movement (1). In FIG. 3, the driven member 209 starts to be lifted up by the cam 200, and the clamp 204 starts to open. The clamp cover 202 starts to open in the circumferential direction. In FIG. 4, the clamp 204 opens broader, and the clamp cover 202 opens broader in the circumferential direction. In FIG. 5, the clamp 204 opens broadest, and the clamp cover 202 opens broadest in the circumferential direction. In a mid-state changing from the state of FIG. 5 to that of FIG. 6, the driven member 214 is lifted up by the cam 201, thereby opening the clamp cover 202 in the radial direction, which movements correspond to the movement (2).

Figure 6:
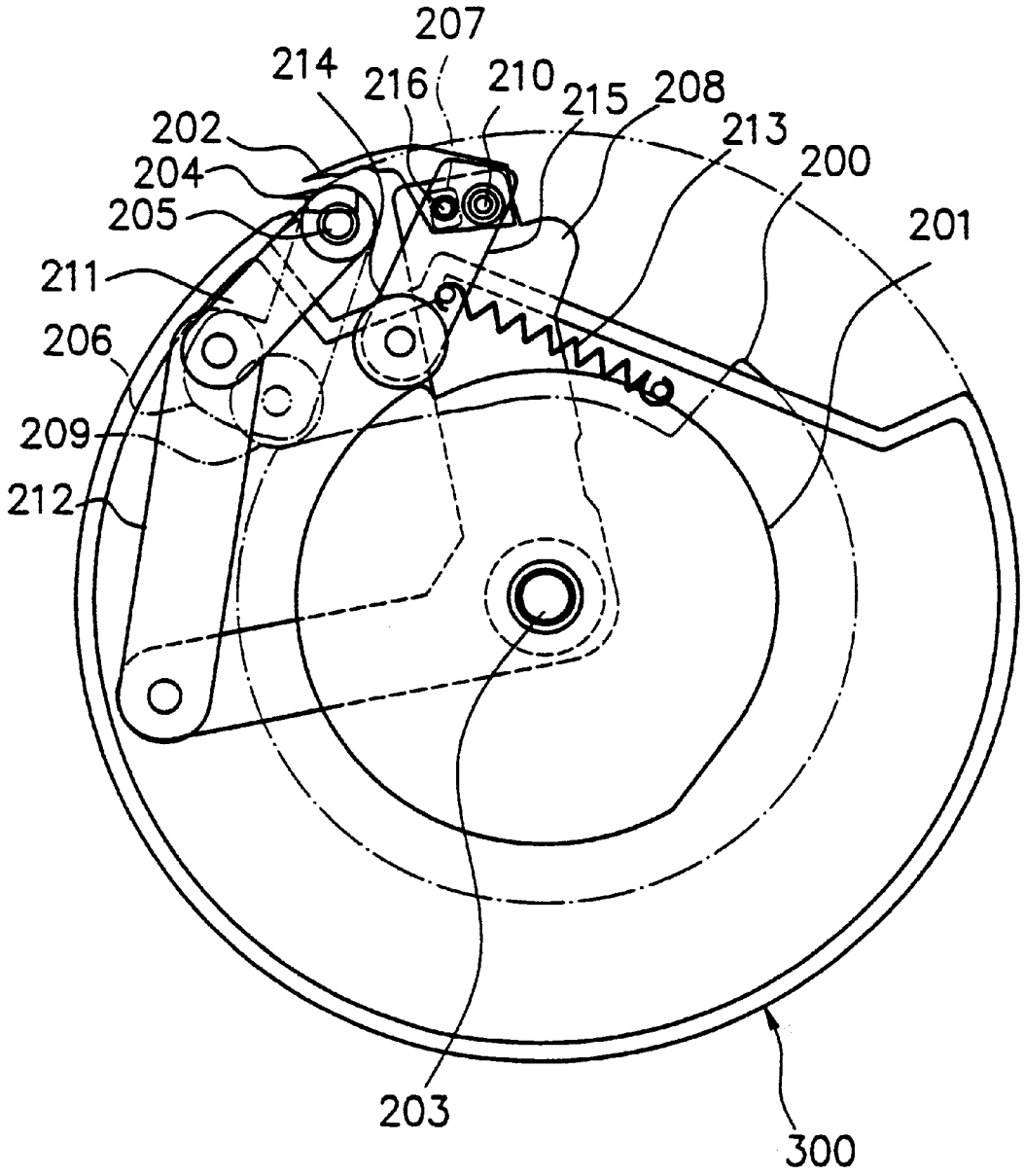
FIG. 6 is a side view illustrating operation of a clamp and a clamp cover in the embodiment of the present invention.

Next, in FIG. 6, the driven member 209 lowers while following the cam 209. The circumferential return-movement of the clamp cover 202, i.e. the movement (3), and the closing movement of the clamp 204 are started.

Figure 7:
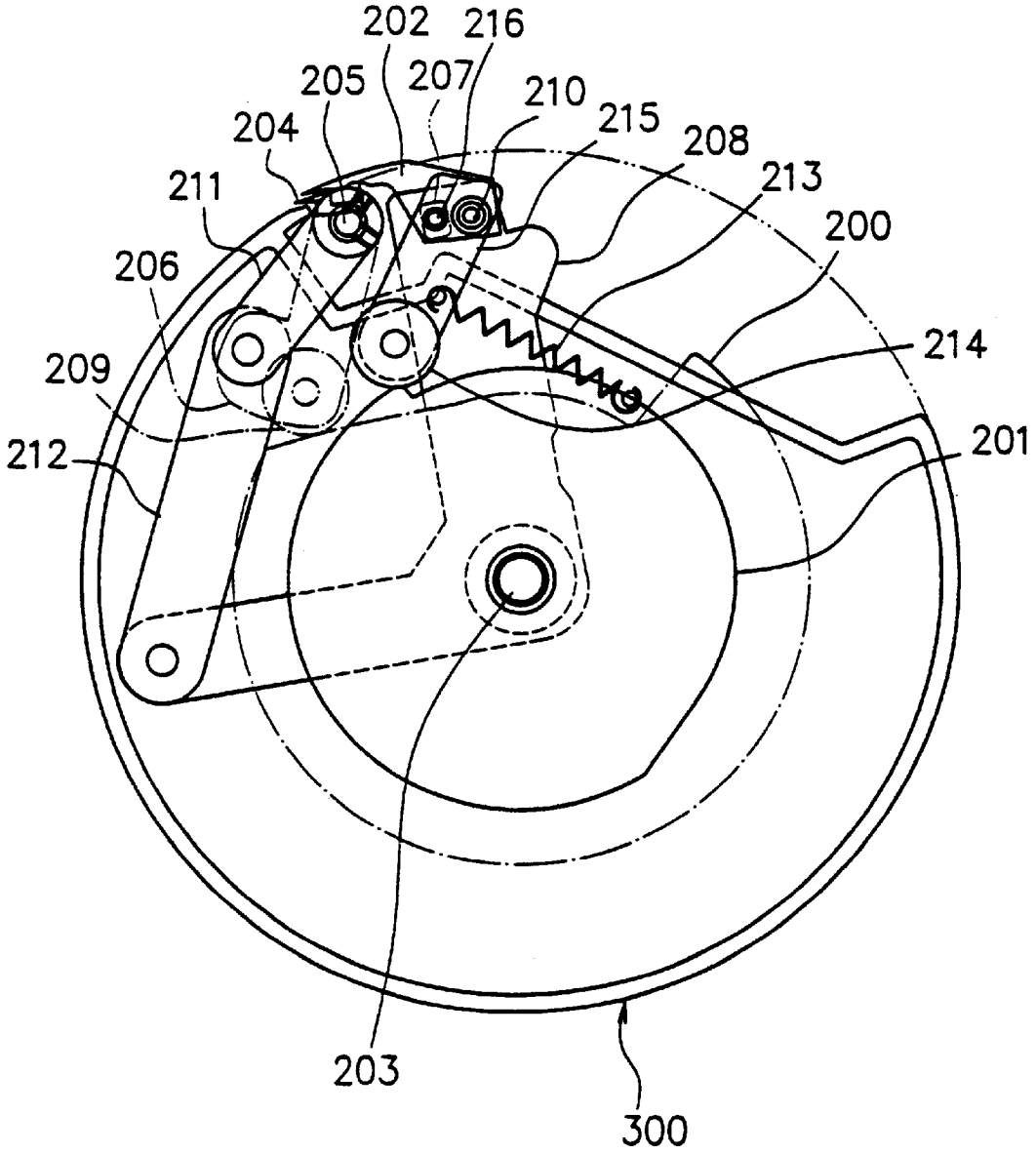
FIG. 7 is a side view illustrating operation of a clamp and a clamp cover in the embodiment of the present invention.

When the rotating state proceeds further from that of FIG. 7, the driven member 214 lowers while following the cam 201, and the clamp cover 202 starts to close in the radial direction of the opposing drum 300, which movements correspond to the movement (4). Further rotation of the opposing drum 300 leads to the state of FIG. 1. The clamp cover 202 is completely closed in the radial direction of the opposing drum 300. Also, the clamp 204 returns to the state where it is completely closed.

Figure 17:
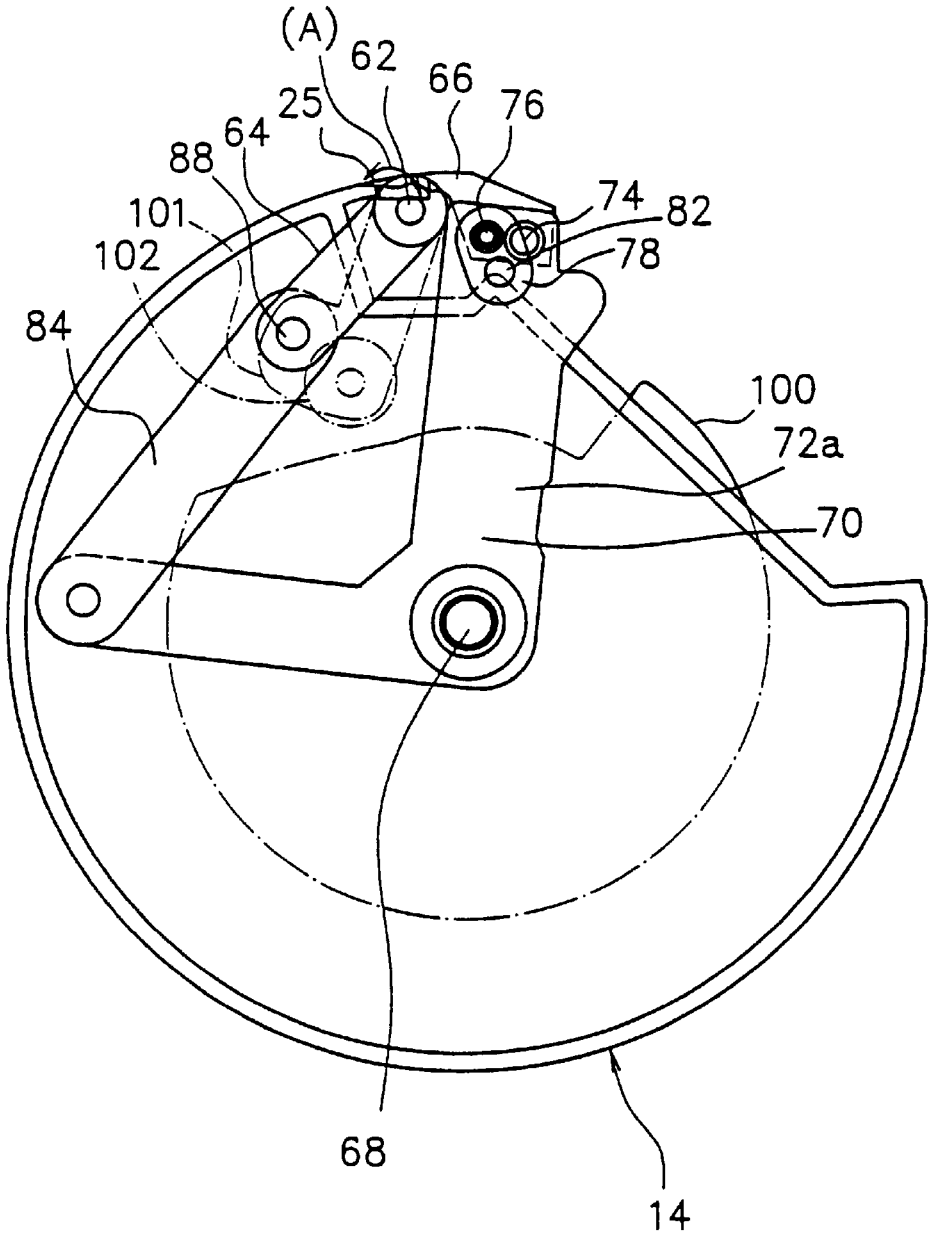
F I G. 17 Prior Art
FIG. 17 is a side view illustrating the printing drum with lines described by the clamp cover of the stencil printing machine previously proposed by the present applicant.
Figure 18:
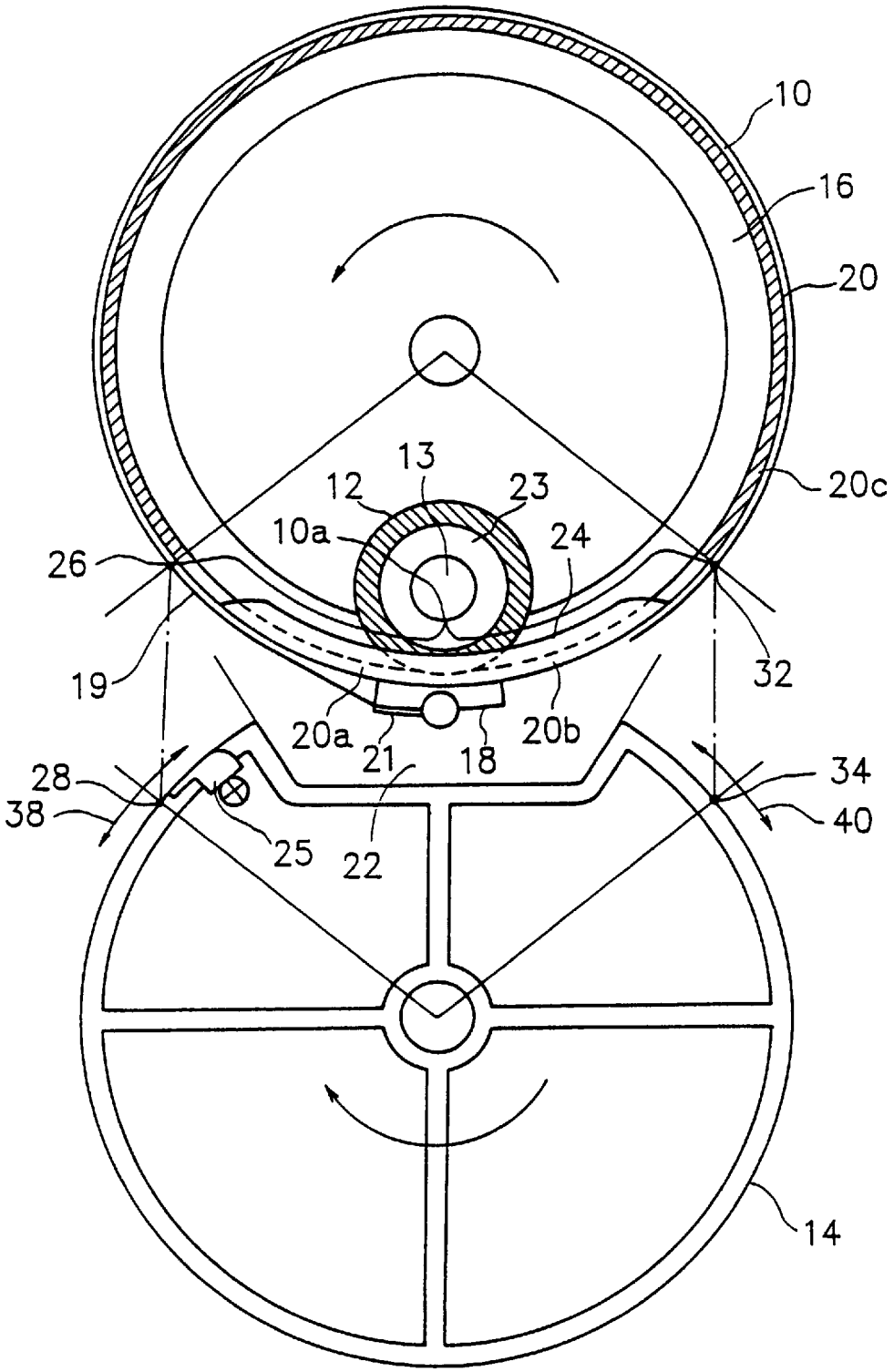
FIG. 18 Prior Art
FIG. 18 is a sectional view of the stencil printing machine previously proposed by the present applicant.
Figure 19:
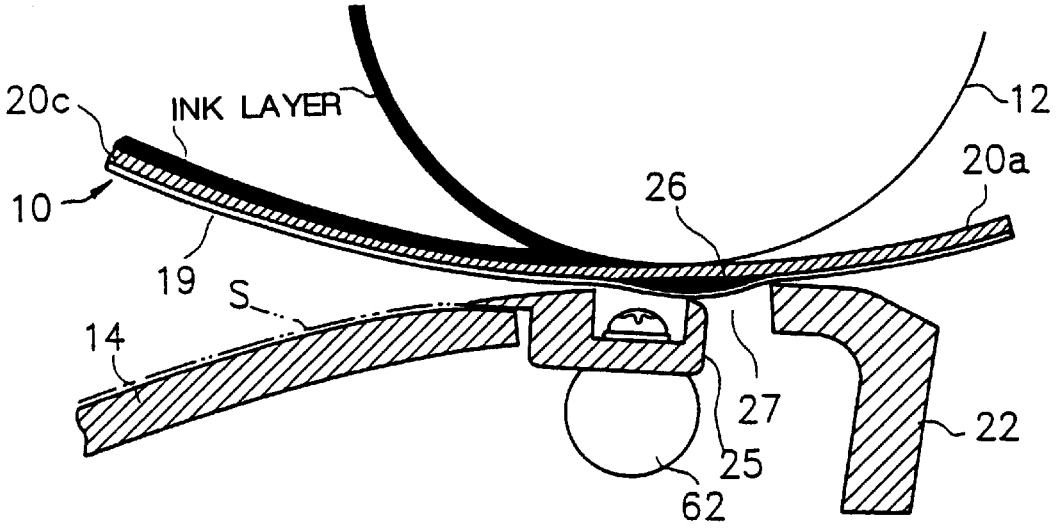
F I G. 19 Prior Art
FIG. 19 is a sectional view illustrating problems of the stencil printing machine shown in FIG. 18.
Figure 20:
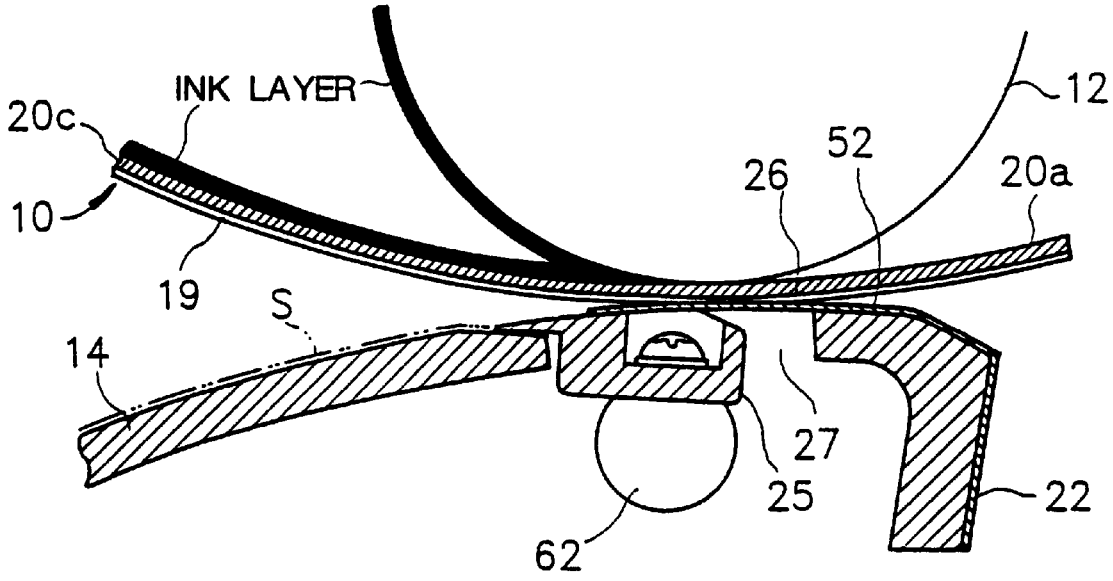
F I G. 20 Prior Art
FIG. 20 is a sectional view illustrating an invention previously proposed by the present applicant to resolve the problems shown in FIG. 19.

According to the present invention, in operating a stencil printing machine comprising a printing drum having a pressing means disposed therein for supplying-ink and an opposing drum having a clamp and a clamp cover, circumferential movement and radial movement is separated and alternately conducted when the clamp cover is moved. Namely, the clamp cover departs from the clamp in the circumferential direction when the clamp opens, and then moves outwardly in the radial direction. The clamp cover approaches the clamp in the circumferential direction when the clamp closes, and then moves inwardly in the radial direction, thereby returning to the initial position. The constitution thus stated produces effects as follows:

(1) Impulsive sound caused by operating a clamp cover is greatly reduced, since the clamp cover of the present invention moves only in the circumferential direction along the circumferential surface of the opposing drum when a printing sheet held by the clamp is discharged. Contrary to this, as illustrated in FIG. 17, in the case where the front end of the clamp cover of the opposing drum describes a curve, impulsive sound caused by operating the clamp cover is very large.

(2) Clamping operation of a supplied printing sheet by the clamp cover can be conducted only by urging force of a spring. Impulsive sheet-clamping sound produced in the operation by the present invention can be further deteriorated relative to the one produced in the forceful sheet-clamping operation by the link mechanism of the related-art previously proposed by the applicant.

(3) In the constitution using the link mechanism of the related art, the clamp and the clamp cover are requested to close at completely the same timing. If the timing is shifted to each other, problems such as a sheet-supplying jam and so on may occur. In the present invention, since the clamp driving mechanism, the circumferential movement mechanism of the clamp cover, and the radial movement mechanism of the clamp cover are separately constituted, the stencil printing machine can be adjusted in such a manner that the clamp cover closes after the clamp closes at a slight interval, so that the problems in the sheet-supplying process can be avoided.

What is claimed is:

1. A stencil printing machine, comprising:

a printing drum having a flexible ink-permeable circumferential wall adapted to receive a perforated stencil sheet around an outer circumferential surface thereof, said printing drum being driven to rotate around a central axis thereof, pressing means situated inside said printing drum for supplying ink to an inner surface of said circumferential wall, said pressing means being movable between a pressing position for pressing said circumferential wall to be deformed radially outwardly and a standing position for releasing said circumferential wall from deformation, an opposing drum disposed adjacent to said printing drum and driven to rotate in a direction opposite to that of said printing drum, a recess formed in an outer circumferential surface of said opposing drum, a clamp having a rotational axis extending parallel to a central axis of said opposing drum and disposed adjacent to said recess and a plate member attached to said rotational axis, said clamp holding a leading edge of a printing sheet supplied between said printing drum and said opposing drum, a clamp cover disposed on said outer circumferential surface of said opposing drum at a rear side of said clamp relative to a direction of rotation of said opposing drum for covering said recess so as to be movable in a circumferential direction and a radial direction of said opposing drum, a clamp driving mechanism attached to said opposing drum for driving said clamp to open and close in synchronization with the rotation of said opposing drum, a circumferential movement mechanism disposed to said opposing drum for moving said clamp cover in the circumferential direction of said opposing drum in synchronization with the rotation of said opposing drum, and a radial movement mechanism disposed to said opposing drum for moving said clamp cover in the radial direction of said opposing drum in synchronization with the rotation of said opposing drum so that when said clamp opens, said clamp cover departs from said clamp in the circumferential direction and then moves radially outwardly of said opposing drum, and when said clamp closes, said clamp cover approaches said clamp in the circumferential direction and then moves radially inwardly of said opposing drum to cover said recess.

2. A stencil printing machine, comprising:

a printing drum having a flexible ink-permeable circumferential wall adapted to receive a perforated stencil sheet around an outer circumferential surface thereof, said printing drum being driven to rotate around a central axis thereof, pressing means situated inside said printing drum for supplying ink to an inner surface of said circumferential wall, said pressing means being movable between a pressing position for pressing said circumferential wall to be deformed radially outwardly and a standing position for releasing said circumferential wall from deformation, an opposing drum disposed adjacent to said printing drum and driven to rotate in a direction opposite to that of said printing drum, a recess formed in an outer circumferential surface of said opposing drum, a clamp having a rotational axis extending parallel to a central axis of said opposing drum and disposed adjacent to said recess and a plate member attached to said rotational axis, said clamp holding a leading edge of a printing sheet supplied between said printing drum and said opposing drum, a clamp driving mechanism having a first arm connected to said rotational axis, a first driven member attached to said first arm, and a first cam for rotating said rotational axis by moving said first driven member upon rotation of said opposing drum so that said clamp opens and closes alternately in synchronization with the rotation of said opposing drum, a clamp cover disposed on said outer circumferential surface of said opposing drum at a rear side of said clamp relative to a direction of rotation of said opposing drum for covering said recess so as to be movable in a circumferential direction of said opposing drum and in a radial direction of said opposing drum, a circumferential movement mechanism having a second arm, said second arm being rotatable around a central axis of said opposing drum and including one end portion connected to said clamp driving mechanism and the other end portion rotatably connected to said clamp cover with a connecting axis so that said clamp cover moves in the circumferential direction of said opposing drum when said clamp opens and closes, and a radial movement mechanism having a third arm rotatably connected to said connecting axis and connected to said clamp cover, a second driven member attached to an end of said third arm, and a second cam for driving said clamp cover to rotate around said connecting axis by moving said second driven member upon rotation of said opposing drum so that said clamp cover moves in the radial direction of said opposing drum when said second arm rotates around said central axis of said opposing drum while said clamp opens and closes, said clamp cover departing from said clamp in the circumferential direction when said clamp opens and next moves radially outwardly of said opposing drum, and approaching said clamp in the circumferential direction when said clamp closes and next moves radially inwardly of said opposing drum to cover said recess.

3. A stencil printing machine as defined in claim 2, further comprising urging means for urging said third arm so that said clamp cover is urged to move radially inwardly of said opposing drum.

4. A stencil printing machine as defined in claim 2, wherein said second arm includes a hole at the other end portion thereof, said third arm being connected to said clamp cover with a connecting member inserted through said hole.

5. A stencil printing machine as defined in claim 2, further comprising a frame for supporting said central axis of said opposing drum, said first cam and said second cam being coaxially fixed to said frame on said central axis while pinching said opposing drum.

* * * * *